US007891520B2

(12) United States Patent
Milne

(10) Patent No.: US 7,891,520 B2
(45) Date of Patent: Feb. 22, 2011

(54) VESSEL FOR CONTAINING, DISPLAYING OR SERVING FOODS

(76) Inventor: Victoria Milne, 73 Calyer, Top Studio, Brooklyn, NY (US) 11222

( * ) Notice: Subject to any disclaimer, the term of this patent is extended or adjusted under 35 U.S.C. 154(b) by 709 days.

(21) Appl. No.: 11/974,180

(22) Filed: Oct. 11, 2007

(65) Prior Publication Data

US 2008/0099491 A1 May 1, 2008

Related U.S. Application Data

(63) Continuation-in-part of application No. 10/811,577, filed on Mar. 29, 2004, now abandoned.

(60) Provisional application No. 60/460,886, filed on Apr. 7, 2003.

(51) Int. Cl.
*B65D 25/24* (2006.01)

(52) U.S. Cl. ..... 220/630; 220/574

(58) Field of Classification Search ..... 220/630, 220/574, 628, 629, 729
See application file for complete search history.

(56) References Cited

U.S. PATENT DOCUMENTS 1,829,232 A * 10/1931 Morehouse ..... 24/576.1
2,798,931 A 7/1957 Naxon
4,016,676 A * 4/1977 Bennick, Jr. ..... 47/65.7
4,121,720 A 10/1978 Hayes
4,506,475 A 3/1985 Elliot
5,044,265 A * 9/1991 Janssen ..... 99/418
D405,290 S 2/1999 Hollinger
6,499,192 B1 * 12/2002 Sawyer ..... 16/442
D479,093 S 9/2003 Ancona
D479,433 S 9/2003 Ancona
RE39,330 E * 10/2006 Tozawa ..... 381/386

* cited by examiner

*Primary Examiner*—Stephen Castellano
(74) *Attorney, Agent, or Firm*—Gottlieb, Rackman & Reisman, P.C.

(57) ABSTRACT

A vessel comprises a basin component and a base component, the base component having at least three support elements of substantially equal size and joined together by at least three connector elements of substantially equal length; at one end, each connector element is attached to one of the support elements, and the connector elements are joined to one another at their respective opposite ends. When the support elements of the base component are placed on a table or counter or other flat surface, and are positioned at equidistant points about the periphery of an imaginary circle having a radius that is substantially the same as the length of each connector element, and a basin component having a radius of curvature that is within certain limits is positioned on the base component, thereby placing the base component in tension, the formation of a stable support for the basin component is enabled.

16 Claims, 4 Drawing Sheets

VESSEL FOR CONTAINING, DISPLAYING OR SERVING FOODS

REFERENCE TO RELATED APPLICATIONS

This application is a continuation-in-part of prior application Ser. No. 10/811,577, filed Mar. 29, 2004, now abandoned, which claims the benefit of prior co-pending U.S. Provisional Patent Application Ser. No. 60/460,886, filed Apr. 7, 2003.

TECHNICAL FIELD

The present invention relates broadly to the field of tableware, and in particular, to a vessel for containing and/or serving and/or displaying foodstuffs or other objects. More specifically, this invention relates to a vessel comprising a base component having a particular design and a basin component having a particular dimensional interrelationship with the base component which enables the base component to uphold the basin component in a stable and esthetically pleasing manner and also permits the basin component to assume various orientations.

BACKGROUND OF THE INVENTION

Despite several thousand years of the design, as well as the manufacture and production, of countless manifestations of tableware and utensils used in the consumption and serving of food, it has been virtually impossible to produce a rounded serving vessel which can be positioned in a stable manner on a flat surface such as a table or counter, unless either a separate base with a flat bottom surface is provided on which or in which the basin component must rest, or in the alternative, the basin component is shaped to provide its own base, i.e., the curvature of the basin component is purposely disrupted or truncated so that the bottom portion of the basin component is flattened or squared-off. In view of these deficiencies of the prior art, it is the principal object of this invention to provide a display/serving vessel for foodstuffs and the like that does not incorporate its own base, thereby avoiding any enforced disruption in the curvature of the basin, while at the same time providing a separate base which does not have a flat bottom surface, yet is esthetically pleasing.

SUMMARY OF THE INVENTION

The invention provides a vessel comprising a basin component and a base component, in which the base component does not have a flat bottom surface, but instead comprises at least three support elements of substantially equal size, joined together by at least three connector elements of substantially equal length; at one end, each connector element is attached to a single support element, and the connector elements are joined to one another at their respective opposite ends. In accordance with the preferred embodiment, the support elements of the base component are spherical with substantially equal radii, and the connector elements are non-rigid chains. When the support elements of the base component are placed on a table or counter or other flat surface, and are positioned at substantially equidistant points about the periphery of an imaginary circle having a radius that is substantially the same as the length of each connector element, then the supports will together define a plane, and the basin component may then be rested upon, and will be supported by, the base component in a stable fashion, provided that the radius of curvature of the basin component falls within certain limits, as hereinafter described.

BRIEF DESCRIPTION OF THE DRAWINGS

These and other aspects, features, objects and advantages of the present invention will become more apparent from the following detailed description of the presently most preferred embodiment thereof (which is given for the purposes of disclosure), when read in conjunction with the accompanying drawings (which form a part of the specification, but which are not to be considered limiting in its scope), wherein.

DETAILED DESCRIPTION OF THE PREFERRED EMBODIMENT

Figure 1:
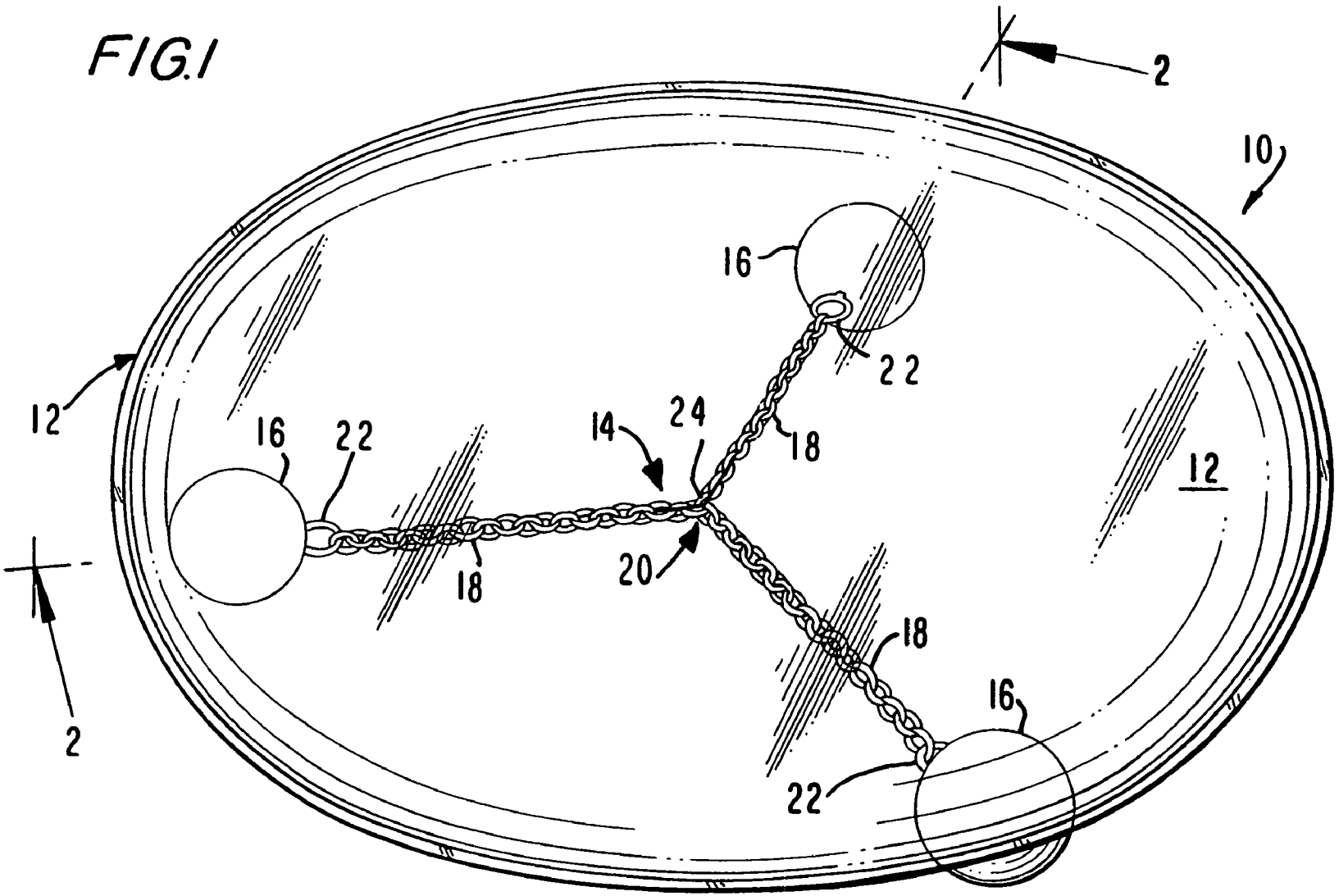
FIG. 1 is a perspective view of the preferred embodiment of the vessel of the present invention, illustrating the basin component resting on the base component, and in which the basin component is fabricated of a substantially transparent material.

The preferred embodiment of the present invention will now be further described with reference to the accompanying drawings, wherein like reference numerals designate like or corresponding parts throughout the several views. Referring first to FIG. 1, a vessel in accordance with the preferred embodiment of the present invention is generally designated 10. Vessel 10 comprises a basin component 12, and a base component which is generally designated 14. Basin component 12 and base component 14 are unattached to one another, but said basin component rests atop said base component when the vessel is in use. Base component 14 comprises a plurality of support elements 16 of substantially equal size, each of which is attached to one end of a connector element 18; all of the connector elements 18 are of substantially equal length, and at their other ends, all of the connector elements 18 are joined to one another at a central point 20. However, the base component 14 itself has no distinct form until a weight is placed upon it.

In the preferred embodiment, the support elements 16 are substantially spherical in shape and have substantially equal radii. Each spherical support element 16 is preferably fabricated of stainless steel, although as will be apparent to those skilled in the art, they may be fabricated instead of other weight-bearing materials of any color, finish or opacity, such as metals (e.g., silver), ceramics, rubber, or polymers.

Preferably, each of the connector elements 18 comprises a non-rigid metal chain, most preferably fabricated of light-gauge stainless steel, although as will be apparent to those skilled in the art, a solid snake chain or even a solid metal rod may be used as the connector element; alternatively, the connector elements may be fabricated of any other flexible or rigid material, including textiles, ceramics and polymers, of any color, finish or opacity. Each connector element 18 has a proximal end and a distal end, and each connector element 18 is joined at its proximal end to a respective support element 16, preferably by a universal joint element 22; the connector elements also join one another at their respective distal ends, preferably in a single chain link 24. It will be apparent to those skilled in the art that the structures shown for joining connector elements 18 at their proximal ends to support elements 16, and for joining connector elements 16 to one another at their distal ends, are illustrative only, and that other suitable structures for joining these elements may be substituted for the structures shown.

As shown in FIG. 1, most preferably the base component 14 comprises no more than three spherical support elements 16, and accordingly, the base component 14 also comprises no more than three connector elements 18; when the support elements 16 are placed on a flat surface, such as a table or a counter top (not shown), and are positioned about the periphery of an imaginary circle (not shown) having a radius that is substantially the same as the length of each connector element 18, the support elements 16 will together define a plane, and the formation of a three-point support for basin component 12 is enabled. As shown in FIG. 1, the basin component 12 may then be rested upon the support elements 16, causing the connector elements 18 to be fully extended, and thereby placing base component 14 in tension. Thus, the basin component 12 may be supported by the base component 14 in a stable fashion. Most preferably, as shown in FIG. 1, the three support elements 16 are placed at substantially equidistant points about the periphery of the imaginary circle defined hereinabove, such that the angle between each successive pair of connector elements 18 is substantially 120°, although such placement is not required.

Although the preferred embodiment for base component 14 has been described and is shown in the drawings, it will be apparent to those skilled in the art that base component 14 may take other forms. For example, in an alternate embodiment the support elements 16 could be connected by bearings (not shown) that would maintain a fixed 120° angular relationship between successive pairs of connector elements 18, while perhaps still allowing rotation of the support elements 16 about an axis (not shown) passing through central point 20.

Preferably, the basin component 12 of the present invention is fabricated of transparent glass, although the basin component could alternatively be fabricated of colored, opaque or mirrored glass; additional alternative materials for the basin component 12 include plastics, ceramics or metals of any color, finish or opacity, as well as resins, textiles, rubbers or even wood fibers. In the preferred embodiment, the lower portion of the basin component 12 is concave in shape and is spherical, i.e., it has a uniform radius of curvature.

Figure 2:
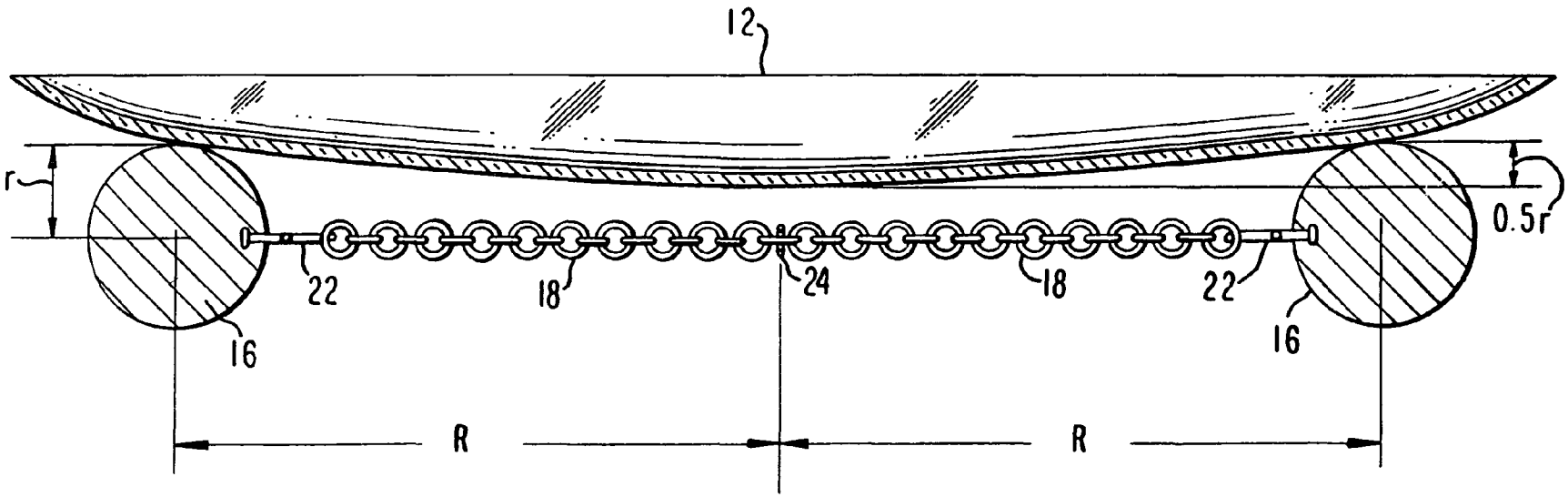
FIG. 2 is a cross-sectional view, taken substantially along the lines 2-2 of FIG. 1, illustrating the shallowest basin component that may be accommodated in a stable condition by the base component.
Figure 3:
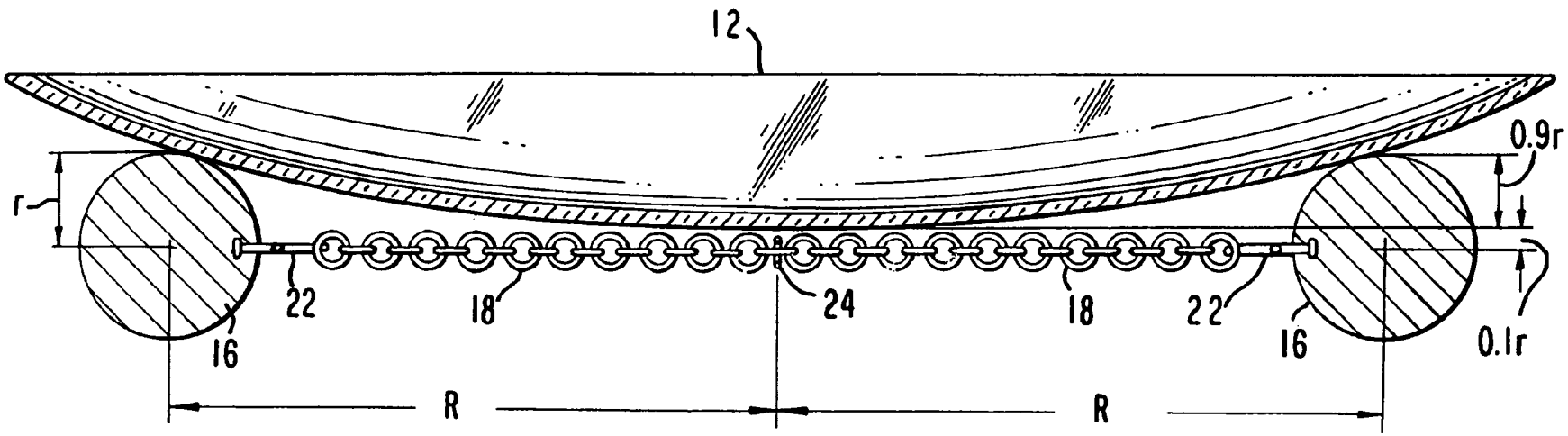
FIG. 3 is similar to FIG. 2, but illustrates the deepest basin component that may be accommodated in a stable condition by the base component.

Turning now to FIGS. 2 and 3 in addition to the aforementioned FIG. 1, it will be apparent to those skilled in the art that the concavity of the lower portion of the basin component 12 must fall within a relatively narrow range in order for the basin component 12 to be supported in a stable fashion by the base component 14. In particular, the basin component 12 must be deep enough such that when it is placed onto the base component 14 it exerts sufficient force to drive the base component 14 into tension (with connector elements 18 extended to their full lengths), yet it must not be so deep that it touches, or even worse, depresses (or otherwise distorts) connector elements 18.

More particularly, for a base component 14 of given dimensions, if the basin component 12 is too deep or concave (i.e., curved on too small a radius), then the basin component 12 would rest on the connector elements 18, rather than on the support elements 16, and for even smaller radii of curvature, the basin component 12 would deform and distort the connector elements and, ultimately, would rest directly on the underlying table or other flat surface, and would not be supported by the base component 14 at all. On the other hand, if the basin component 12 is too shallow or flat (i.e., curved on too large a radius), then the vessel would become unstable, and ultimately, for even larger radii of curvature, the basin component 12 (and its contents, if any) would slip off the base component 14. In general, the shallowest basin component 12 that can be supported in a stable fashion by a base component 14 of given dimensions is shown in FIG. 2, while the deepest basin component that can be supported in a stable fashion by a base component 14 of the same dimensions is depicted in FIG. 3.

In relative terms, and as shown in FIGS. 2 and 3, if the radius of the spherical support elements 16 is represented by r, and the radius of the base component 14 when it is in tension (as measured from the center of each spherical support element 16 to the central point 20) is represented by R, and if the thickness of connector elements 18 is about 0.2 r, then assuming uniform concavity of the lower portion of basin component 12, the vertical rise over the course of an arc of horizontal distance R cannot be any less than about 0.5 r (FIG. 2) and cannot be any greater than about 0.9 r (FIG. 3).

The assembled vessel includes several features that are individually and/or collectively novel as a consequence of the interrelationship between the basin component and the base component. The basin component incorporates an ability to rotate about its vertical center line upon the base component, in the same fashion as a "lazy susan." Also, the basin component, while remaining in contact with the base component, can be swiveled such that the mouth of the basin component is skewed away from the horizontal, so as to facilitate a user's ability to more easily reach into the basin component in order to insert or extract items or to allow the basin component to sit in a skewed position. Because the vessel's supports form the points of contact with the underlying surface, the vessel may also be rolled or slid laterally across that surface while retaining its horizontal orientation, such that items contained within the vessel would not fall out during movement even if the basin component were skewed relative to the horizontal.

Although in the preferred embodiment the concavity of the lower portion of basin component 12 is uniform, it is to be understood that the present invention can be used even with basin components of varying concavity, i.e., those having a conical or fluted shape, and that basin components having square, diamond or other cross-sectional shapes (even irregular shapes such as floral or kidney shapes) can also be used.

Figure 4:
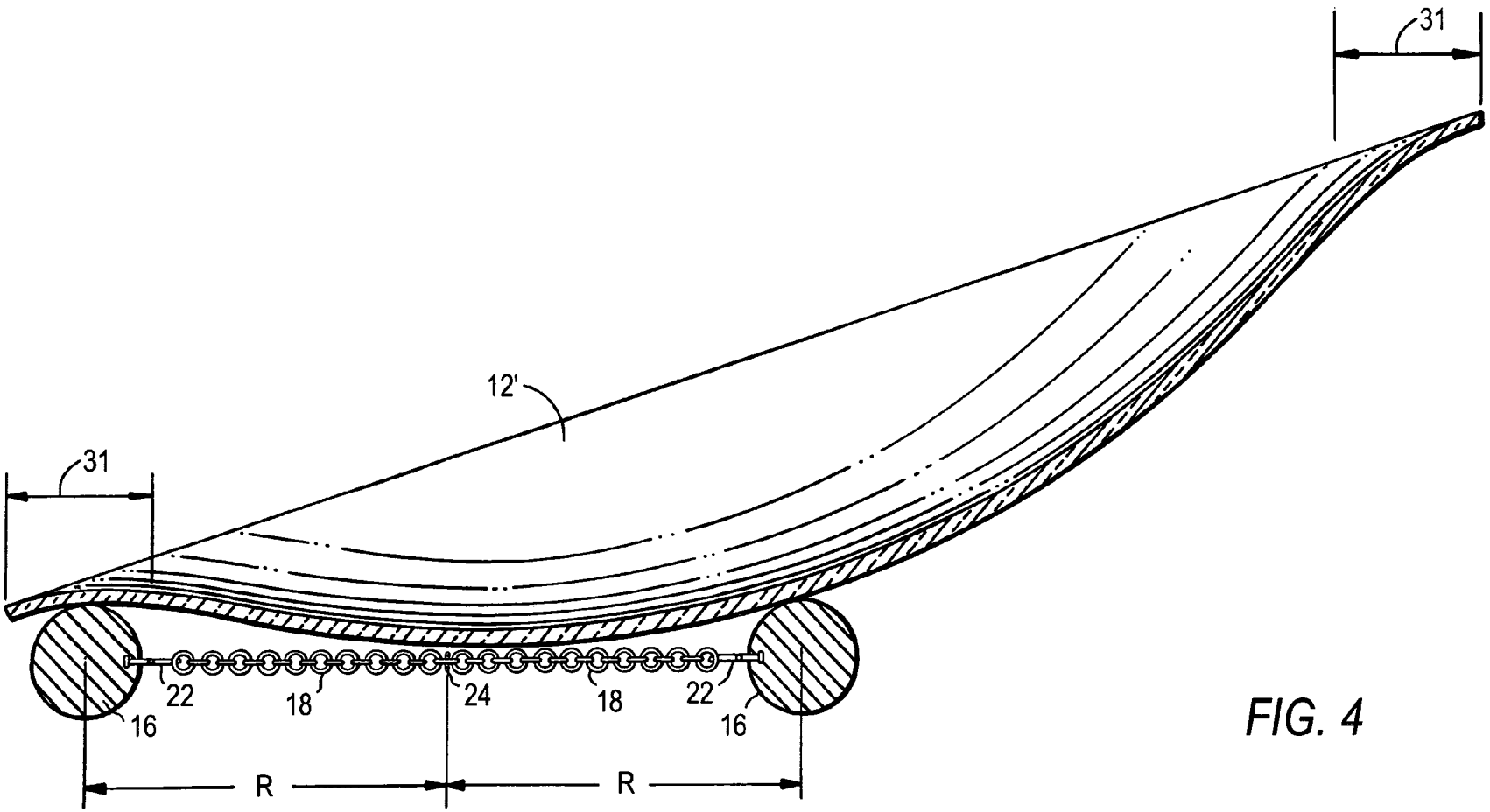
FIG. 4 is similar to FIG. 2, but additionally illustrates a curved lip with an indentation at the crest of the basin, usable as a stop for one or more supports.

FIG. 4 illustrates basin component 12', a variation of basin component 12, wherein the basin component includes a lip area 31 at its crest. In the most preferred embodiment, the lip area 31 is present along the entire periphery of the crest of basin component 12'. In alternative embodiments, lip segments may be present at one or more discrete along the crest of basin component 12', such as at three discrete positions generally separated by 120° (not shown in the drawings); other arrangements are also possible. The underside of the lip area 31 by its nature encompasses a reciprocal indented portion on the exterior of basin component 12', and this indented portion acts to preclude over-swiveling and to allow the mouth of basin component 12' to remain stationary in at least one non-horizontal position. Thus, as shown in FIG. 4, as the basin is swiveled on the base, the extent of swivel is stopped once one of the support elements 16 enters an indented portion of the underside of a lip area 31.

Absolute dimensions for the various elements of the present invention in its most preferred embodiment will now be provided, but it is to be understood that these dimensions are provided for illustrative purposes only. The support elements 16 of the base component 14 comprise stainless steel spheres with a diameter of one inch, each of which is joined using an eye element 0.1875 inches wide to a connector element 18 comprising a stainless steel chain, the length of which is 2.5625 inches. Thus, the overall distance from the center of each support element to the link 24 at central point 20 is 3.25 inches when the base component 14 is extended in tension. When these dimensions are used, and assuming that the glass of basin component 12 is 0.125 inches in thickness, the dimensions of the basin components which may be supported in a stable fashion include a basin component having a diameter of 8 inches which is concave on a radius of 22 inches, as well as a basin component having a diameter of 10 inches which is concave on a radius of 23 inches.

It is to be understood that while the concavity of the lower portion of the basin component 12 must fall within a relatively narrow range in order for the basin component 12 to be supported in a stable fashion by a base component 14 of given dimensions, basin components of greater or lesser concavity can be supported if the dimensions of the base component 14 are changed, i.e., if the diameter of the spherical support elements 16 and/or the lengths of the connector elements 18 are varied in a manner that will be apparent to those skilled in the art.

While there has been described what are at present considered to be the preferred embodiments of the present invention, it will be apparent to those skilled in the art that the embodiments described herein are by way of illustration and not of limitation, and that various changes and modifications may be made therein without departing from the true spirit and scope of the present invention, as set forth in the appended claims.

The invention claimed is:

1. A vessel for containing, displaying or serving foodstuffs and the like, said vessel comprising a base component and a basin component adapted to be upheld by the base component and of a uniform radius of curvature, said base component comprising at least three supports and at least three connectors, each of said supports being substantially spherical in shape, each said connector having a proximal end and a distal end and positioned beneath said basin component, with each connector being attached at its proximal end with a rotatable joint to a respective support, said connectors being substantially equal in length and being joined to one another at their distal ends to form a junction, said junction being adapted to be positioned at the center of an imaginary circle having a radius that is substantially the same as the length of each connector, and each of said supports being adapted to be positioned about the periphery of said imaginary circle, whereby the basin component may be rested upon and upheld by said supports so as to permit the basin component to be rotated about its vertical axis and/or rotated about another axis such that the orientation of the mouth of the basin component is offset from a horizontal plane while the basin component retains contact with each of said supports and rests in an offset position.

2. A vessel according to claim 1 wherein said supports are adapted to be positioned at substantially equidistant points about the periphery of said imaginary circle.

3. A vessel according to claim 2 wherein the shape of each of said supports is selected from the group consisting of a solid sphere, a faceted sphere, and a floral shape.

4. A vessel according to claim 1 wherein each of said supports is substantially solid.

5. A vessel according to claim 4 wherein each said support comprises a ball fabricated from a first material selected from the group consisting of a metal, rubber, a ceramic and a polymer.

6. A vessel according to claim 5 wherein said first material comprises stainless steel.

7. A vessel according to claim 6 wherein each connector is fabricated from a second material selected from the group consisting of metals, textiles, ceramics and polymers.

8. A vessel according to claim 7, wherein said second material comprises stainless steel, and wherein each of said connectors comprises a flexible chain fabricated therefrom.

9. A vessel according to claim 8 wherein each of said supports carries a universal joint, and each said joint is coupled to the chain link at the proximal end of a respective one of said connectors.

10. A vessel according to claim 9 wherein the connectors are joined to one another at the chain link at the distal end of each chain.

11. A vessel according to claim 10 wherein said basin component is fabricated from a third material selected from the group consisting of glass, metals, ceramics, plastics, resins, rubbers, textiles and wood fibers.

12. A vessel according to claim 11 wherein said third material is glass.

13. A vessel according to claim 12 wherein said base component comprises three supports and three connectors.

14. A vessel according to claim 1 wherein the basin component further comprises a lip.

15. A vessel according to claim 1 wherein the basin component is formed with at least one lip segment and with reciprocal indentation on the exterior of the basin component adjacent to said at least one lip segment.

16. A vessel according to claim 15 wherein said lip segment is substantially adjacent to the mouth.

* * * * *